US009735490B2

(12) United States Patent
Wu et al.

(10) Patent No.: US 9,735,490 B2
(45) Date of Patent: Aug. 15, 2017

(54) ELECTRICAL CONNECTOR TERMINAL

(75) Inventors: Jianfeng Wu, Shanghai (CN); Zhenyu Chen, Shanghai (CN); Lihao Liu, Shanghai (CN); Yuanchun Chen, Shanghai (CN); Feirong Zhou, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 13/476,547

(22) Filed: May 21, 2012
(Under 37 CFR 1.47)

(65) Prior Publication Data

US 2013/0143451 A1 Jun. 6, 2013

(30) Foreign Application Priority Data

May 20, 2011 (CN) ..... 2011 1 0134093

(51) Int. Cl.
*H01R 13/24* (2006.01)
*H01R 13/11* (2006.01)

(52) U.S. Cl.
CPC ..... *H01R 13/24* (2013.01); *H01R 13/113* (2013.01)

(58) Field of Classification Search
CPC ..... H01R 13/2442; H01R 13/24; H01R 13/11
USPC ..... 439/839–862
See application file for complete search history.

(56) References Cited

U.S. PATENT DOCUMENTS

| | | | | |
|---|---|---|---|---|
| 3,808,578 | A * | 4/1974 | Hansen | 439/595 |
| 4,002,400 | A * | 1/1977 | Evans | 439/748 |
| 4,572,606 | A * | 2/1986 | Neumann et al. | 439/843 |
| 4,699,444 | A * | 10/1987 | Isohata | 439/839 |
| 4,734,041 | A * | 3/1988 | Bruchmann et al. | 439/637 |
| 4,892,492 | A * | 1/1990 | Mueller | 439/828 |
| 4,919,628 | A * | 4/1990 | Mobley et al. | 439/858 |
| 5,135,417 | A * | 8/1992 | Stanevich | 439/851 |
| 5,383,800 | A * | 1/1995 | Saka et al. | 439/787 |
| 5,601,458 | A * | 2/1997 | Ohsumi et al. | 439/852 |
| 5,645,459 | A * | 7/1997 | Fitting | 439/857 |
| 6,547,608 | B2 * | 4/2003 | Sato et al. | 439/852 |
| 6,790,101 | B1 * | 9/2004 | Data et al. | 439/851 |
| 6,811,450 | B1 * | 11/2004 | Data et al. | 439/748 |
| 7,278,891 | B2 * | 10/2007 | Cvasa et al. | 439/852 |
| 8,152,576 | B2 * | 4/2012 | Nakamura et al. | 439/852 |
| 2001/0034167 | A1 * | 10/2001 | Ketelsleger | 439/851 |
| 2007/0218763 | A1 * | 9/2007 | Rehbein et al. | 439/607 |
| 2009/0253314 | A1 * | 10/2009 | Shimizu | 439/852 |

* cited by examiner

*Primary Examiner* — Briggitte R Hammond
(74) *Attorney, Agent, or Firm* — Barley Snyder

(57) ABSTRACT

An electrical connector terminal comprises a resilient contact end) for electrically contacting with an insertion end of a mating electrical connector terminal. At least one side of the resilient contact end contacts with the insertion end at a plurality of electrical contact portions separated from each other in a longitudinal direction.

9 Claims, 3 Drawing Sheets

ELECTRICAL CONNECTOR TERMINAL

CROSS-REFERENCE TO RELATED APPLICATION

This application claims the benefit of the filing date under 35 U.S.C. §119(a)-(d) of Chinese Patent Application No. 201110134093.3, filed May 20, 2011.

FIELD OF THE INVENTION

The invention relates to an electrical connector terminal, and more particularly, relates to an electrical connector terminal being capable of stably and electrically contacting with a mating electrical connector terminal.

BACKGROUND

FIG. 1 shows a conventional electrical connector terminal 10 comprising an end (left end of FIG. 1) adapted to be crimped on a conductor of a wire and a resilient contact end (right end of FIG. 1) configured to electrically contact with an insertion end 20 of a mating electrical connector terminal.

As shown in FIG. 1, the resilient contact end of the electrical connector terminal 10 includes a pair of opposite resilient cantilevers 10*a*, 10*b* each having only one electrical contact portion a, b. The electrical contact portions a, b of the pair of resilient cantilevers 10*a*, 10*b* face to each other. In this way, when the insertion end 20 of the mating electrical connector terminal is inserted between the pair of resilient cantilevers 10*a*, 10*b* of the electrical connector terminal 10, the pair of electrical contact portions a, b of the pair of resilient cantilevers 10*a*, 10*b* electrically contact with both sides of the insertion end 20 of the mating electrical connector terminal, respectively.

In the conventional electrical connector terminal 10 shown in FIG. 1, each of the resilient cantilevers 10*a*, 10*b* electrically contacts with the insertion end 20 of the mating electrical connector terminal at only one electrical contact portion. Accordingly, the electrical connector terminal 10 likely displaces relative to the mating electrical connector terminal, which causes the electrical contact of the electrical connector terminal and the mating electrical connector terminal unstable.

In addition, because each side of the electrical connector terminal contacts with the mating electrical connector terminal at only one electrical contact portion, the contact area between the electrical connector terminal and the mating electrical connector terminal is relatively small, which causes the contact resistance therebetween to be relatively high and deteriorates the conductive performance of them.

SUMMARY

The present invention has been made to overcome or alleviate at least one aspect of the above mentioned disadvantages.

According to an aspect of the present invention, there is provided an electrical connector terminal comprises a resilient contact end for electrically contacting with an insertion end of a mating electrical connector terminal. At least one side of the resilient contact end of the electrical connector terminal contacts with the insertion end of a mating electrical connector terminal at a plurality of electrical contact portions separated from each other in a longitudinal direction of the resilient contact end.

BRIEF DESCRIPTION OF THE DRAWINGS

The above and other features of the invention will become more apparent by describing in detail illustrative embodiments thereof with reference to the accompanying drawings, in which.

DETAILED DESCRIPTION OF THE EMBODIMENTS

Figure 1:
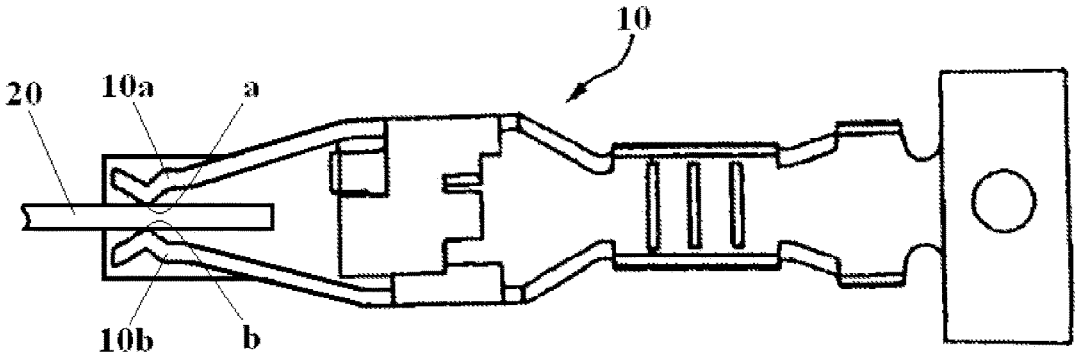
Fig. 1 Prior Art
FIG. 1 is a planar view of a conventional electrical connector terminal.

Illustrative embodiments of the invention will be described hereinafter in detail with reference to the attached drawings, wherein the like reference numerals refer to the like elements. The invention may, however, be embodied in many different forms and should not be construed as being limited to the embodiments set forth herein.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 2:
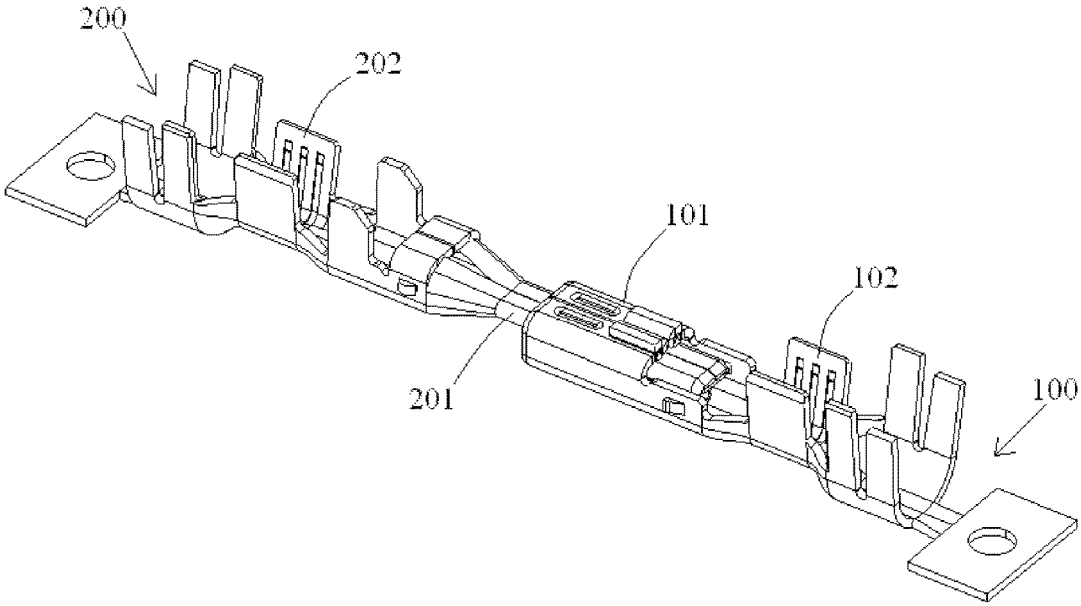
FIG. 2 is a perspective view of an electrical connector terminal mated with a mating electrical connector terminal according to an embodiment of the invention.

As shown in FIG. 2, the electrical connector terminal 100 has a resilient contact end 101 and a crimping end 102 opposite to the resilient contact end 101. The mating electrical connector terminal 200 has an insertion end 201 and a crimping end 202 opposite to the insertion end 201.

Referring to FIG. 2, the insertion end 201 of the mating electrical connector terminal 200 is configured to be inserted into the resilient contact end 101 of the electrical connector terminal 100 to achieve an electrical connection therebetween.

The crimping end 102 is configured to be crimped on a conductor of a wire, and the crimping end 202 is also configured to be crimped on a conductor of another wire. In this way, the two wires can be electrically connected by the electrical connector terminal 100 and the mating electrical connector terminal 200.

Figure 3:
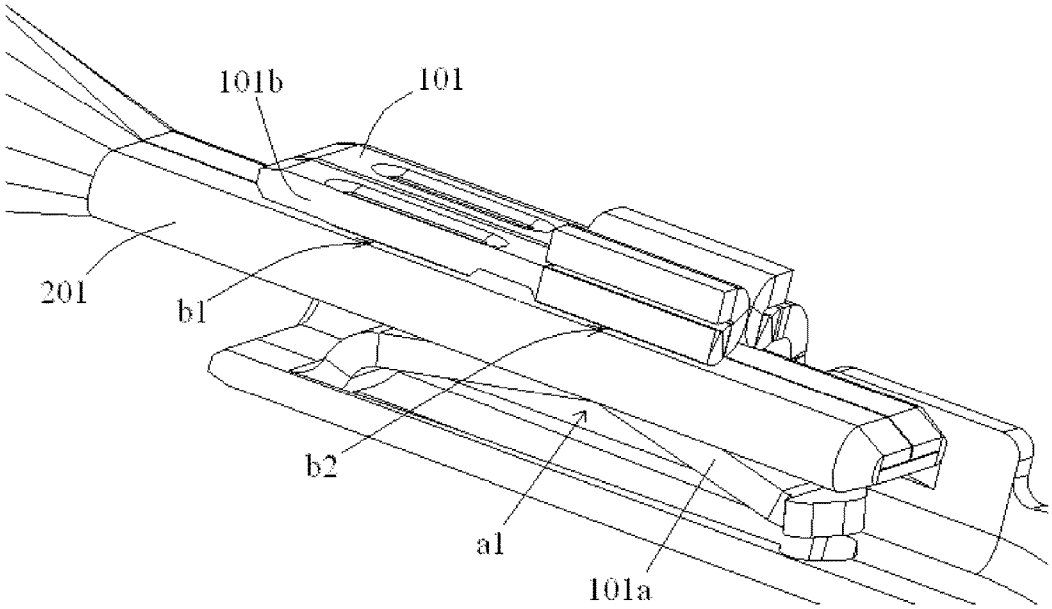
FIG. 3 is an enlarged cutaway perspective view showing an electrical contact region of the electrical connector terminal and the mating electrical connector terminal of FIG. 2, in which an electrical contact feature of a contact end of the electrical connector terminal and an insertion end of the mating electrical connector terminal are exposed by cutting a wall.

In FIG. 3 part of wall 101*b* is cut away to show internal features of the electrical connector terminal 100 and the mating electrical connector terminal 200.

Figure 4:
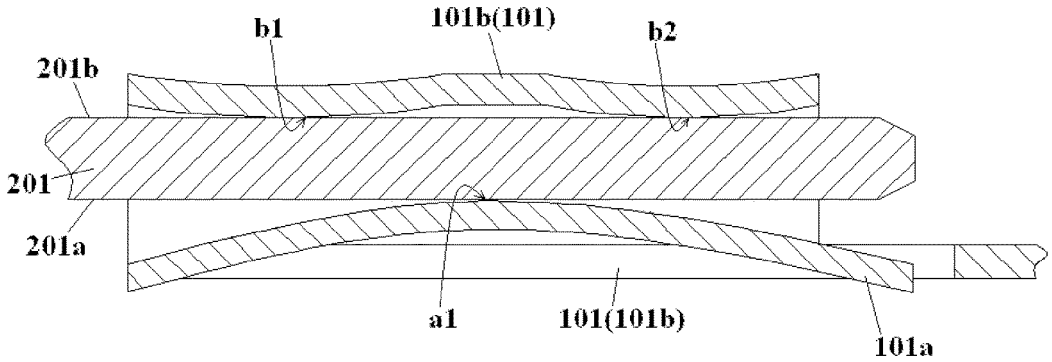
FIG. 4 is a sectional view of the electrical contact region of the electrical connector terminal and the mating electrical connector terminal of FIG. 2, in which electrical contact portions of the electrical connector terminal and the mating electrical connector terminal are shown.

FIG. 4 is a longitudinal cross section of the electrical contact region of the electrical connector terminal 100 and the mating electrical connector terminal 200 of FIG. 2, in which electrical contact portions a1, b1, b2 of the electrical connector terminal 100 and the mating electrical connector terminal 200 are shown.

As shown in FIGS. 3 and 4, the insertion end 201 of the mating electrical connector terminal 200 has a pair of opposite side surfaces 201*a*, 201*b*. The resilient contact end 101 of the electrical connector terminal 100 has a resilient cantilever 101*a* and a rigid wall 101*b* opposite to the resilient cantilever 101*a*.

As shown, there is one first electrical contact portion a1 between one side surface 201*a* and the resilient cantilever 101*a*, and there are two second electrical contact portions b1, b2 between the other side surface 201*b* and the wall 101*b*.

It should be noted that the invention is not limited to the illustrative embodiment shown in FIGS. 3 and 4. For example, there may be two or more first electrical contact portions between the one side surface 201*a* and the resilient cantilever 101*a*. Also, there may me one, three or more second electrical contact portions between the other side surface 201*b* of the mating electrical connector terminal 200 and the wall 101*b*.

In the embodiment of FIGS. 3 and 4, because the wall 101*b* is substantially stationary, it can reliably limit the displacement of the other side surface 201*b* to ensure the stability of the electrical connection of the electrical connector terminal 100 and the mating electrical connector terminal 200.

Referring again to FIGS. 3 and 4, the two second electrical contact portions b1, b2 are separated from each other in a longitudinal or insertion direction. The one first electrical contact portion a1 is located between the two adjacent second electrical contact portions b1, b2. In this way, the insertion end 201 of the mating electrical connector terminal 200 is stabilized during insertion along the longitudinal direction preventing angular insertion and stubbing of insertion end 201. In an embodiment of the invention, the one first electrical contact portion a1 is located in the middle of the two adjacent second electrical contact portions b1, b2.

As shown in FIGS. 2-4, a resilient cantilever 101*a* has a base end integrally connected to the wall 101*b* and a free end extending toward the crimping end 102. The resilient cantilever 101*a* is received in an opening formed in the wall 101*b* and protrudes inward from the opening of the wall 101*b*. That is, the resilient cantilever 101*a* protrudes toward the one side surface 201*a*.

In the embodiment illustrated in FIGS. 3 and 4, the electrical connector terminal 100 has an insertion chamber formed and surrounded by the rigid wall 101*b*, and the insertion chamber is configured to receive the insertion end 201 of the mating electrical connector terminal 200. Thereby, when the insertion end 201 is inserted into the insertion chamber, the insertion end 201 is surrounded by the wall 101*b* to limit the displacement of the electrical connector terminal 100 within the insertion chamber and to further improve the stability of the electrical connection of the electrical connector terminal 100 and the mating electrical connector terminal 200.

Figure 5:
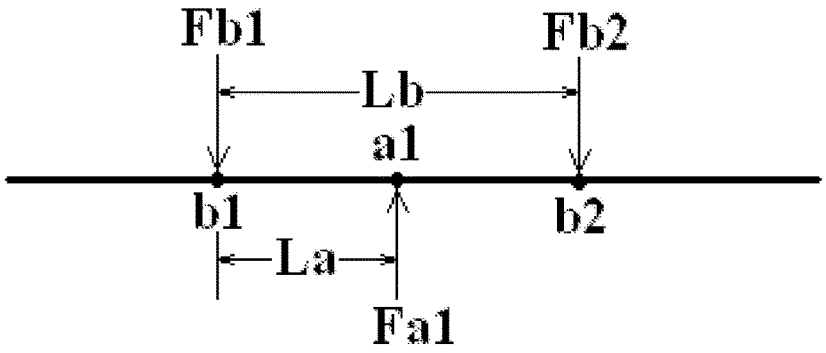
FIG. 5 is diagram showing a mechanical lever principle constructed by the electrical contact portions of the electrical connector terminal and the mating electrical connector terminal.

FIG. 5 shows a diagram of mechanical lever principle constructed by the electrical contact portions a1, b1, b2 of the electrical connector terminal 100 and the mating electrical connector terminal 200. As shown there and with reference to FIG. 4, a first contact force Fb1 is exerted on the insertion end 201 of the mating electrical connector terminal 200 at the electrical contact portion b1 by the electrical connector terminal 100, a second contact force Fb2 is exerted on the insertion end 201 of the mating electrical connector terminal 200 at the electrical contact portion b2 by the electrical connector terminal 100, and a third contact force Fa1 is exerted on the insertion end 201 of the mating electrical connector terminal 200 at the electrical contact portion a1 by the electrical connector terminal 100.

According to the force equilibrium principle, an equation (1) can be obtained as follows.

$$Fa1=Fb1+Fb2 \quad (1).$$

Furthermore, if the electrical contact portion b1 is given as the fulcrum point, the contact force Fb2 has a force arm Lb relative to the fulcrum point b1, and the contact force Fa1 has a force arm La relative to the fulcrum point b1. According to the mechanical lever principle, an equation (2) can be obtained as follows.

$$Fb2\times Lb=Fa1\times La \quad (2).$$

Accordingly, the contact stability of the electrical connector terminal 100 and the mating electrical connector terminal 200 can be improved by means of the force lever constructed by the electrical contact portions a1, b1, b2.

Figure 6:
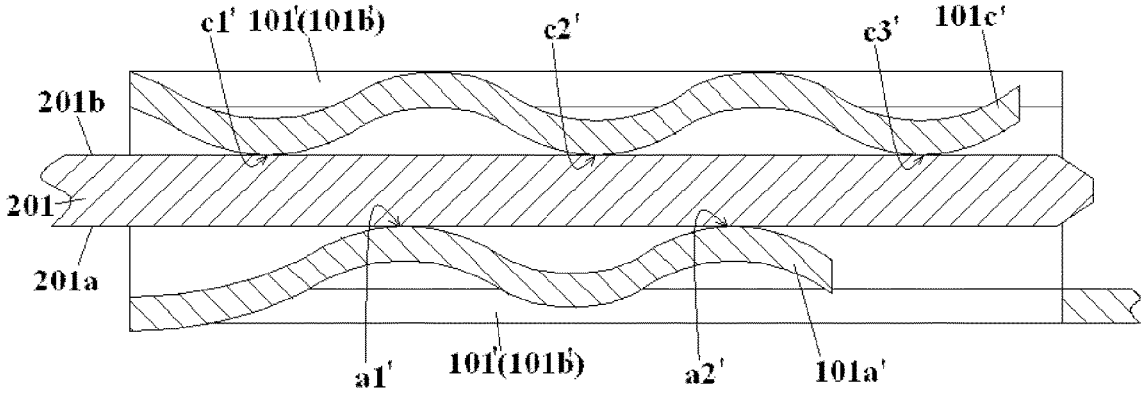
FIG. 6 is a sectional view showing an electrical connector terminal mated with a mating electrical connector terminal according to another illustrative embodiment of the invention.

FIG. 6 shows another embodiment of the invention. In this embodiment, the insertion end 201 of the mating electrical connector terminal 200 has a pair of opposite side surfaces 201*a*, 201*b*. The resilient contact end 101' of the electrical connector terminal 100' has a first resilient cantilever 101*a*' and a second resilient cantilever 101*c*' opposite to the first resilient cantilever 101*a*'.

Referring again to FIG. 6, there are two first electrical contact portions a1', a2' between one side surface 201*a* and the first resilient cantilever 101*a*', and there are three second electrical contact portions c1', c2', c3' between the other side surface 201*b* and the second resilient cantilever 101*c*'.

It should be noted however, that the invention is not limited to the embodiment shown and the number of the first electrical contact portion between one side surface 201*a* of the mating electrical connector terminal 200 and the first resilient cantilever 101*a*' may be three or more while the number of the second electrical contact portions between the other side surface 201*b* and the second resilient cantilever 101*c*' of the electrical connector terminal 100 may be two, four or more.

Referring again to FIG. 6, all electrical contact portions a1', a2', c1', c2', c3' are separated from each other in the longitudinal direction of the resilient contact end 101. One first electrical contact portion a1 is located between two adjacent second electrical contact portions c1', c2', and the other first electrical contact portion a1' is located between two adjacent second electrical contact portions c2', c3'. In this way, the insertion end 201 is horizontally stabilized along the longitudinal direction, preventing angular insertion and stubbing of the insertion end 201. In another embodiment of the invention, the one first electrical contact portion a1' is located in the middle of the two adjacent second electrical contact portions c1', c2', and the other first electrical contact portion a2' is located in the middle of the two adjacent second electrical contact portion c2', c3'.

As shown in FIG. 6, the resilient cantilevers 101*a*', 101*b*' each has a base end connected to the rigid wall 101*b*' and the resilient cantilevers 101*a*', 101*b*' each has a free end extending toward the crimping end 102' of the electrical connector terminal 100' opposite to the resilient contact end 101'. The resilient cantilevers 101*a*', 101*b*' are each received in an opening formed in the wall 101*b*' and the resilient cantilevers 101*a*', 101*b*' each protrude inward from the opening of the wall 101*b*'. That is, the resilient cantilevers 101*a*', 101*b*' protrude toward the side surfaces 201*a*, 201*b* of the insertion end 201, respectively.

In the embodiment of FIG. 6, the electrical connector terminal 100' has an insertion chamber formed and surrounded by the wall 101*b*'. The insertion chamber is configured to match with the insertion end 201 of the mating electrical connector terminal 200. Thereby, when the insertion end 201 of the mating electrical connector terminal 200 is inserted into the insertion chamber of the electrical connector terminal 100', the insertion end 201 is surrounded by the rigid wall 101*b*' to limit the displacement of the electrical connector terminal 100' within the insertion chamber and to further improve the stability of the electrical connection of the electrical connector terminal 100' and the mating electrical connector terminal 200.

Similar as the illustrative embodiment of FIG. 5, the electrical contact portions a1', a2', c1', c2', c3' between the electrical connector terminal 100' and the mating electrical connector terminal 200 shown in FIG. 6 construct a mechanical lever, therefore, the contact stability of the electrical connector terminal 100' and the mating electrical connector terminal 200 can be improved.

Although several illustrative embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector, comprising:

a resilient contact end of an electrical connector terminal having an outer rigid wall having a plurality of second electrical contact portions positioned adjacent to each other and separated from each other along a longitudinal direction; and a first side positioned opposite the outer rigid wall, having a base integrally connected to the outer rigid wall, and a single resilient cantilever extending from the base toward a crimping end having a plurality of first electrical contact portions, each first electrical contact portion positioned between adjacent second electrical contact portions in the longitudinal direction, the plurality of first electrical contact portions contacting a first side surface of an insertion end of a mating electrical connector terminal and the plurality of second electrical contact portions simultaneously contacting an opposite second side surface of the insertion end.

2. The electrical connector according to claim 1, wherein a number of the second electrical contact portions is greater than the number of the first electrical contact portions.

3. The electrical connector according to claim 1, wherein one of the second electrical contact portions is located between two adjacent first electrical contact portions.

4. The electrical connector according to claim 1, wherein the resilient cantilever has a base connected to a wall of the resilient contact end, and a free end extending toward an opposite end of the electrical connector terminal.

5. The electrical connector according to claim 4, wherein the opposite end of the electrical connector terminal is configured to be crimped onto a conductor.

6. The electrical connector according to claim 5, wherein another end of the mating electrical connector terminal is configured to be crimped onto another conductor.

7. The electrical connector according to claim 1, wherein the resilient cantilever is received in an opening formed in the base and protrudes inward from the opening.

8. The electrical connector according to claim 1, wherein the electrical connector terminal has an insertion chamber formed by the wall configured to receive the insertion end of the mating electrical connector terminal.

9. An electrical connector, comprising:

a resilient contact end of an electrical connector terminal having a first resilient cantilever extending from a first base including a plurality of first electrical contact portions, and a second resilient cantilever extending from a second base integrally connected to the first base and including a plurality of second electrical contact portions, the plurality of first electrical contact portions and the plurality of second electrical contact portions contacting an insertion end of a mating electrical connector terminal, each first electrical contact portion positioned between adjacent second electrical contact portions.

* * * * *